US010246317B2

(12) United States Patent
Kapure

(10) Patent No.: US 10,246,317 B2
(45) Date of Patent: Apr. 2, 2019

(54) PUSH PEDAL WATER DISPENSER ASSEMBLY

(71) Applicant: WHIRLPOOL CORPORATION, Benton Harbor, MI (US)

(72) Inventor: Narendra A. Kapure, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/376,912

(22) Filed: Dec. 13, 2016

(65) Prior Publication Data

US 2018/0162715 A1 Jun. 14, 2018

(51) Int. Cl.

| | |
|---|---|
| ***B67D 3/00*** | (2006.01) |
| ***B67D 3/02*** | (2006.01) |
| ***F25D 23/12*** | (2006.01) |
| ***B67D 7/06*** | (2010.01) |

(52) U.S. Cl.

CPC ..... *B67D 3/0003* (2013.01); *B67D 3/02* (2013.01); *B67D 7/06* (2013.01); *F25D 23/126* (2013.01); *B67D 3/00* (2013.01); *F25D 23/12* (2013.01); *F25D 2323/122* (2013.01)

(58) Field of Classification Search

CPC ..... B67D 3/0003; B67D 3/02; B67D 7/06; B67D 3/00; F25D 23/126; F25D 23/12; F25D 2323/122

USPC ..... 222/470, 474, 471; 292/DIG. 37

See application file for complete search history.

(56) References Cited

U.S. PATENT DOCUMENTS

| | | | | |
|---|---|---|---|---|
| 6,425,425 | B2 | 7/2002 | Bianchi et al. | |
| 7,216,900 | B2 * | 5/2007 | Liu | E05C 3/162 292/111 |
| 7,501,594 | B2 | 3/2009 | Fulton et al. | |
| 7,604,264 | B2 * | 10/2009 | Lin | E05B 1/0046 292/1 |
| 7,806,446 | B2 * | 10/2010 | Oh | B60R 7/06 292/137 |
| 8,109,541 | B2 * | 2/2012 | Chang | E05B 17/0037 292/101 |
| 8,857,206 | B2 | 10/2014 | Fulton et al. | |
| 9,073,743 | B2 | 7/2015 | Sanchez et al. | |
| 2010/0319388 | A1 | 12/2010 | Yang et al. | |
| 2011/0259719 | A1 * | 10/2011 | Park | F25D 23/126 200/310 |
| 2012/0107453 | A1 * | 5/2012 | Chase | F25D 23/126 426/66 |
| 2013/0241386 | A1 * | 9/2013 | Kim | A47B 71/00 312/404 |
| 2018/0045442 | A1 * | 2/2018 | Park | F25B 41/04 |

* cited by examiner

*Primary Examiner* — Donnell A Long

(74) *Attorney, Agent, or Firm* — Price Heneveld LLP

(57) ABSTRACT

A water dispenser assembly for a refrigerator includes a housing having a front fascia with an actuator receiving area. An actuator is received in the actuator receiving area and includes inner and outer surfaces. The actuator is operable between at-rest and pressed positions. A hinge pin includes upper and lower ends with a body portion disposed therebetween. The upper and lower ends are pivotally coupled to upper and lower portions of the actuator receiving area to rotate the body portion of the hinge pin between extended and retracted positions. The body portion is further coupled to the inner surface of the actuator for movement therewith.

20 Claims, 7 Drawing Sheets

PUSH PEDAL WATER DISPENSER ASSEMBLY

BACKGROUND

The present device generally relates to water dispensers, and in particular, to water dispensers for use with refrigerator appliances, wherein the water dispenser includes a push pedal actuator.

Various types of water dispensers have been developed. One type of water dispenser includes a push pedal actuator that is configured for linear movement between at-rest and pressed or actuated positions, wherein the water dispenser assembly dispenses water when the actuator is in the actuated position. Such pedals generally have a large outer contact surface which can lead to users pressing the pedal at various vertical locations along the outer contact surface. This can cause the pedal actuator to become jammed due to uneven application of pressure across the outer contact surface. This can lead to unpredictable dispensing of water. A smooth and even action for the actuator pedal, regardless of the vertical point of contact by a user, between at-rest and pressed positions is desired.

SUMMARY

One aspect of the present concept includes a water dispenser assembly for a refrigerator. The assembly includes a housing having a front fascia with an actuator receiving area. An actuator is received in the actuator receiving area and includes inner and outer surfaces. The actuator is operable between at-rest and pressed positions. A hinge pin includes upper and lower ends with a body portion disposed therebetween. The upper and lower ends are pivotally coupled to upper and lower portions of the actuator receiving area to rotate the body portion of the hinge pin between extended and retracted positions. The body portion is further coupled to the inner surface of the actuator for movement therewith.

Another aspect of the present concept includes a water dispenser assembly for a refrigerator. The assembly includes a housing having an actuator receiving area with upper and lower mounting apertures. An actuator is received in the actuator receiving area and is longitudinally moveable between at-rest and pressed positions. A hinge pin includes a body portion with off-set upper and lower ends. The off-set upper and lower ends are pivotally coupled to the upper and lower mounting apertures of the actuator receiving area to rotate the body portion of the hinge pin between extended and retracted positions. The body portion is further coupled to an inner surface of the actuator for movement therewith.

Yet another aspect of the present concept includes a water dispenser assembly for a refrigerator. The assembly includes a housing having an actuator receiving area with upper and lower portions. An actuator is received in the actuator receiving area. The actuator is operable between at-rest and actuated positions. A hinge pin includes upper and lower ends that are pivotally coupled to the upper and lower portions of the actuator receiving area to rotate the hinge pin between extended and retracted positions. The hinge pin is coupled to an inner surface of the actuator for movement therewith.

These and other features, advantages, and objects of the present device will be further understood and appreciated by those skilled in the art upon studying the following specification, claims, and appended drawings.

DETAILED DESCRIPTION OF EMBODIMENTS

Figure 2:
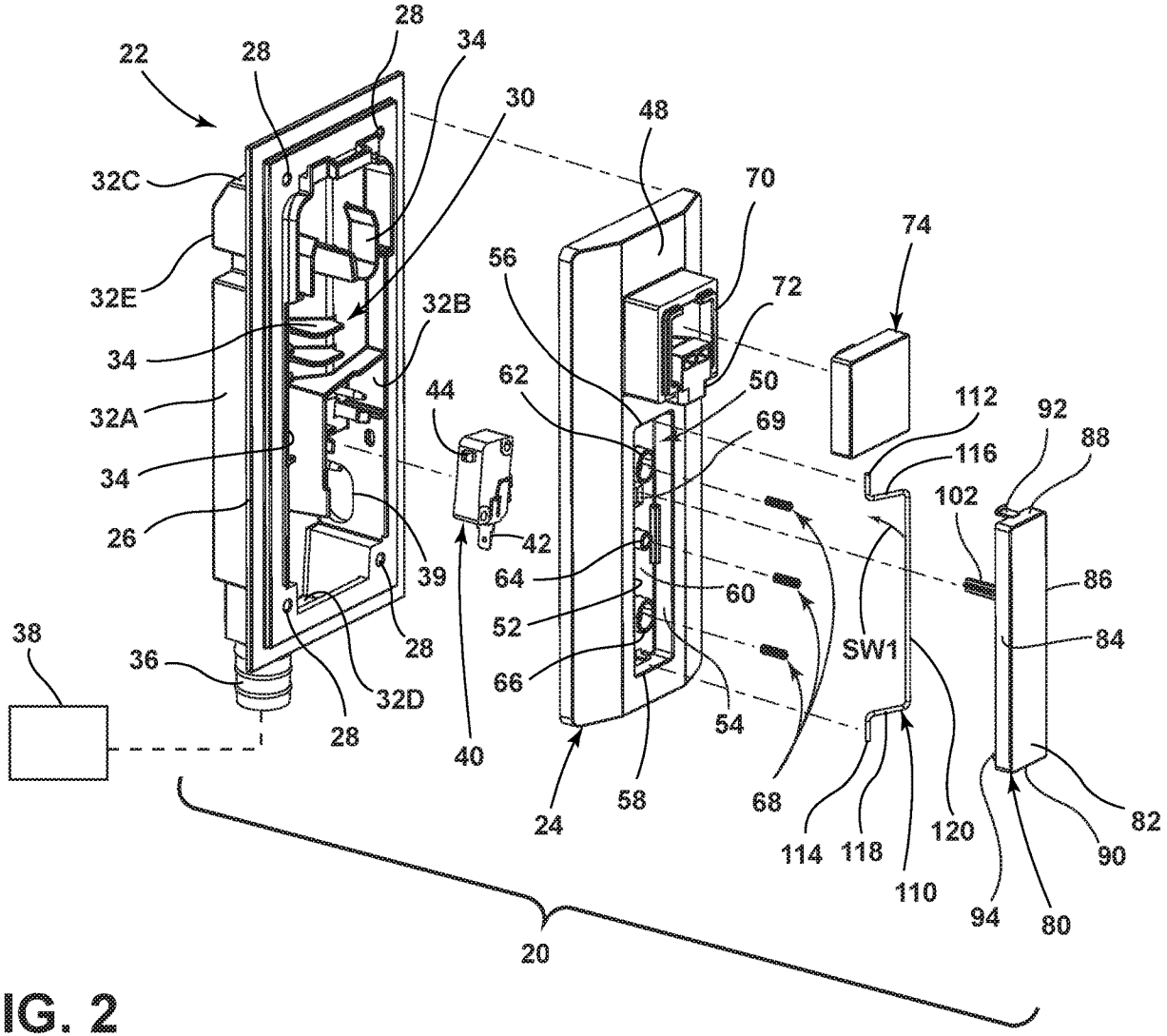
FIG. 2 is an exploded top perspective view of the water dispenser assembly of FIG. 1.

For purposes of description herein the terms "upper," "lower," "right," "left," "rear," "front," "vertical," "horizontal," and derivatives thereof shall relate to the device as oriented in FIG. 2. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
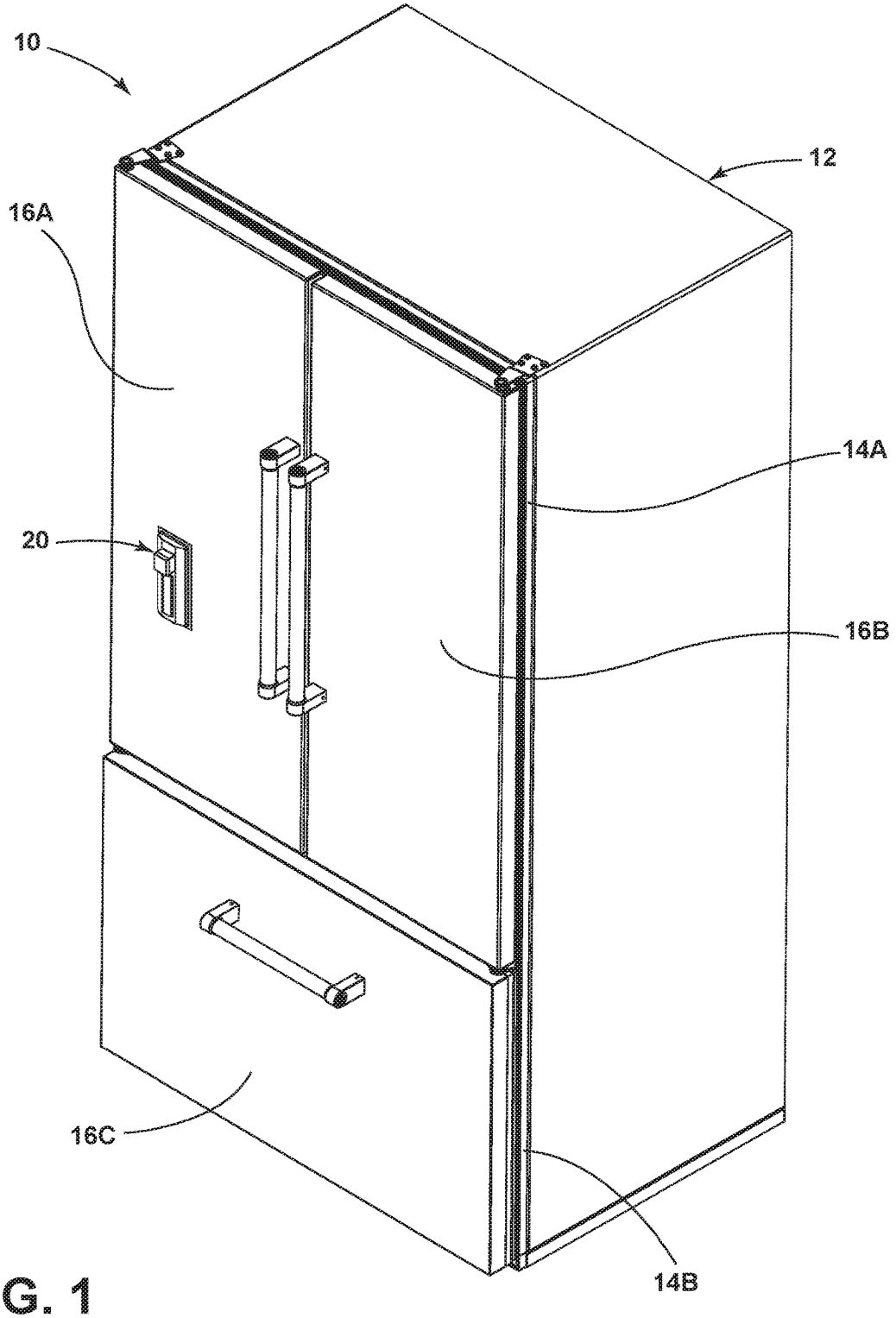
FIG. 1 is a front perspective view of a refrigerator including a water dispenser assembly.

Referring now to FIG. 1, a refrigerator 10 is shown having an insulated cabinet structure 12 with one or more front openings 14A, 14B that may be closed off by doors 16A, 16B, and 16C. The doors 16A, 16B are contemplated to pivot between open and closed positions relative to upper front opening 14A. The upper front opening 14A is contemplated to open into a refrigerator compartment of the refrigerator 10. As further found in the illustrated example, door 16C is in the form of a sliding drawer which horizontally slides between open and closed positions for selectively providing access to the lower front opening 14B. The lower front opening 14B is contemplated to provide access to a freezer compartment of the refrigerator 10.

As further shown in FIG. 1, a water dispenser assembly 20 is shown positioned on door 16A. While the water dispenser assembly 20 of the present concept is shown disposed on door 16A, it is also contemplated that the water dispenser assembly 20 can be positioned on any part of the refrigerator 10 including any external surface of the insulated cabinet 12, the various doors of the cabinet 12 or an internal surface disposed within the insulated cabinet 12. The water dispenser assembly 20 is contemplated to provide cooled water from the refrigerator 10 from a water source to which the refrigerator 10 is connected. It is further contemplated that the refrigerator 10 can provide various filters for filtering water from the water source before being dispensed by the water dispenser assembly 20.

Referring now to FIG. 2, the water dispenser assembly 20 is shown having a housing 22 which includes a front fascia 24. The housing 22 includes a mounting plate 26 to which the front fascia 24 is operably coupled at mounting apertures 28. The housing 22 further includes an inset cavity 30 defined by a plurality of walls 32A-32E. Specifically, the walls 32A-32E are defined as first and second sidewalls 32A, 32B, upper and lower walls 32C, 32D and rear wall 32E. As shown in FIG. 2, the cavity 30 includes a plurality of mounting structures 34 which are used to help mount components of the water dispenser assembly 20 in the cavity 30. As further shown in FIG. 2, a hose connecting tube 36 is shown extending downwardly from lower wall 32D and opening into cavity 30. The hose connecting tube 36 is contemplated to connect to a water source 38 of the refrigerator 10. In this way, water is provided to the water dispenser assembly 20 and the housing 22 may include any number of water directing connections disposed within the cavity 30 to provide water to an actual dispenser, as further described below.

As further shown in FIG. 2, an electronic switch 40 is shown having a downwardly extending male connecting tab 42 and an input contact 44 disposed on a side surface thereof. In assembly, the electronic switch 40 is coupled to a power source of the refrigerator 10 at male connecting tab 42 to power the electronic switch 40. In use, an actuator is configured to contact the electronic switch 40 at the input contact 44 for actuation the switch and initiating a water dispensing sequence. As shown in FIG. 2, the electronic switch 40 is contemplated to be received in the cavity 30 of the housing 22, and leads for connecting the electronic switch 40 to a power supply of the refrigerator 10 can access the cavity 30 through a receiving aperture 39 disposed in sidewall 32B of the housing 22. While the input contact 44 of the electronic switch 40 is contemplated for contact by an actuator to initiate a water dispensing sequence, it is contemplated that any other form of contact may be provided for activating the electronic switch 40. Such contacts may include an electrical contact, a physical/mechanical contact, a magnetic field change contact or an indirect contact between the actuator and the electronic switch 40 that includes multiple intermediate contacts therebetween.

As further shown in FIG. 2, the front fascia 24 includes an outer surface 48 and an inset actuator receiving area 50. The inset actuator receiving area 50 includes first and second sidewalls 52, 54 and upper and lower walls 56, 58. The upper and lower walls 56, 58 may be referred to herein as upper and lower portions of the actuator receiving area 50. The actuator receiving area 50 further includes a rear wall 60 from which a plurality of mounting bosses 62, 64 and 66 outwardly extend. The mounting bosses 62, 64 and 66 are configured to receive biasing mechanisms 68 shown in the form of coil springs in FIG. 2, as further described below. The rear wall 60 of the actuator receiving are 50 further includes an access aperture 69 disposed therethrough which aligns with the electronic switch 40 in assembly. In use, the access aperture 69 of the actuator receiving area 50 is configured to provide access to a portion of an actuator through the actuator receiving area 50 for selectively contacting the input contact 44 of the electronic switch 40. The front fascia 24 further includes a dispenser housing 70 having a dispenser 72 disposed thereon. The dispenser housing 70 is positioned vertically above the actuator receiving area 50, such that water is dispensed downward from the dispenser 72 into a receptacle that is used to actuate a water dispensing sequence. The dispenser housing 70 is closed off by a dispenser housing cap 74 shown exploded away from the dispenser housing 70 in FIG. 2.

As further shown in FIG. 2, an actuator 80 is shown having a front contact surface 82. The front contact surface 82 may include a non-slip or flexibly resilient type cover for gripping a receptacle used to actuate the actuator 80. The actuator 80 further includes first and second sidewalls 84, 86, and upper and lower walls 88, 90 which all extend rearwardly from the outer contact surface 82. As shown in FIG. 2, the upper and lower walls 88, 90 may be referred to as upper and lower portions of the actuator 80 which include upper and lower retainer members 92, 94 rearwardly extending from the upper and lower walls 88, 90, respectively. In FIG. 2, the upper and lower retainer members 92, 94 are shown in the form of flexibly resilient clip members. The actuator 80 further includes an inner surface 100 (FIG. 5) from which a rearwardly extending arm 102 outwardly extends. In assembly, the rearwardly extending arm 102 is received through the receiving aperture 69 of the actuator receiving area 50 and includes a distalmost contact end 104 which is used to contact the input contact 44 of the electronic switch 40 for initiating a water dispensing sequence. The inner surface 100 is further described below and best illustrated in FIG. 5. In the embodiment shown in FIG. 2, the actuator 80 is in the form of an elongate actuator pedal, wherein the outer contact surface 82 is an elongate vertically disposed front contact surface which can be pressed at various vertical positions by a user when initiating a water dispensing sequence. The actuator 80 may be commonly referred to in the art as a dispenser pedal, paddle, pad or pod.

As further show in FIG. 2, the water dispenser assembly 20 includes a hinge pin 110 having first and second ends 112, 114 which are off-set by offset portions 116, 118 from a body portion 120 which interconnects the first and second ends 112, 114. As shown in the illustrated example of FIG. 2, the first and second ends 112, 114 define upper and lower ends of the hinge pin 110. In assembly, the hinge pin 110 is configured to couple to the actuator 80 at the body portion 120 thereof, while further pivotally coupling to the upper and lower portions 56, 58 of the actuator receiving area 50 at first and second ends 112, 114, respectively. The hinge pin 110 is configured for rotational movement along a swing path SW1 as the actuator 80 moves linearly between at-rest and pressed positions, as further described below. Being pivotally coupled to the actuator receiving area 50 and further coupled to the actuator 80, the pivoting movement of the hinge pin 110 along swing path SW1 helps to provide smooth and even linear movement of the actuator 80 between at-rest and pressed/actuated positions. As shown in FIG. 2, the body portion 120 of the hinge pin 110 is commensurate with a length of the vertically disposed actuator 80, such that the body portion 120 is configured to couple to the actuator 80 and run substantially the length of the actuator 80, as further described below.

Figure 3:
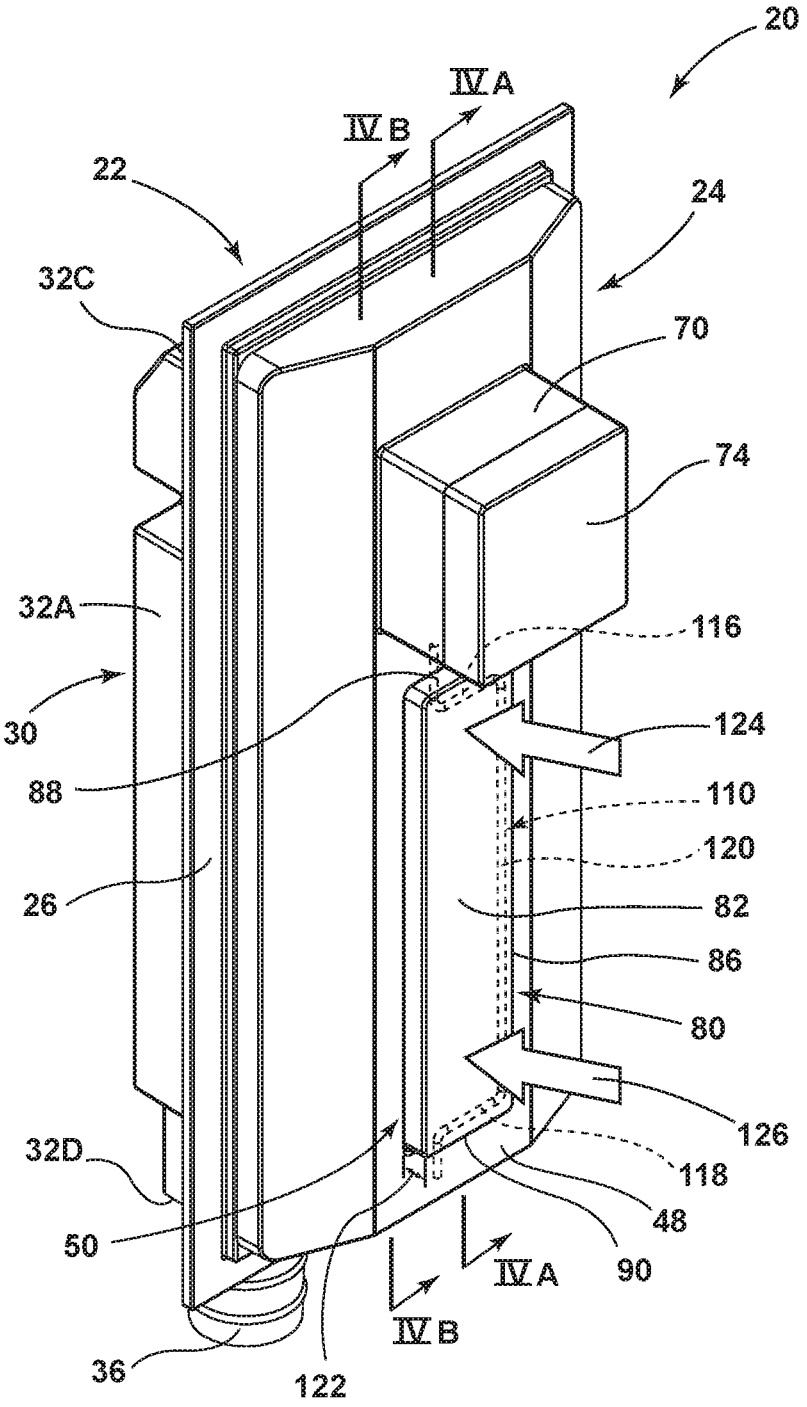
FIG. 3 is a top perspective view of the water dispenser assembly of FIG. 2 shown in an assembled condition.

Referring now to FIG. 3, the actuator 80 is disposed within the actuator receiving area 50 of the front fascia 24. The front fascia 24 is shown coupled to the housing 22 and is contemplated to be a part of the housing 22. As received in the actuator receiving area 50, the actuator 80 is configured for linear movement along the path as indicated by arrow 122. In the position shown in FIG. 3, the actuator 80 is contemplated to be in an at-rest or outwardly disposed position. With the actuator 80 in this position, the water dispenser assembly 20 will not dispense water. When a user wishes to dispense water, the actuator 80 is contacted at the outer contact surface 82 and moved inwardly into the actuator receiving area 50 along the path as indicated by arrow 122 to a pressed or actuated position. The movement of the actuator 80 between the at-rest and actuated positons is contemplated to include approximately 1-5 mm of travel. It is important that the actuator 80 move in a consistent and even manner between the at-rest and actuated positions without sticking or jamming.

In FIG. 3, two different vertical locations of contact are identified by arrows 124, 126. Arrow 124 illustrates contact of the outer contact surface 82 of the actuator 80 at an upper portion of the actuator 80. Arrow 126 illustrates contact with the outer contact surface 82 of the actuator 80 at a lower portion of the actuator 80. As noted above, the body portion 120 of the hinge pin 110 has a length that runs commensurate with the length of the actuator 80. Thus, as shown in FIG. 3, the hinge pin 110 is shown in phantom with offset portions 116, 118 running along upper and lower portions 88, 90 of the actuator 80 and the body portion 120 of hinge pin 110 running along the length of sidewall 86. Thus, the body portion 120 of the hinge pin 110 runs along an inner surface 100 (FIG. 5) of the actuator 80 between uppermost and lowermost portions thereof. The swing path SW1 (FIG. 2) of the hinge pin 110 shows a movement of the hinge pin 110 between extended and retracted positions that correlates to movement of the actuator 80. With the hinge pin 110 coupled to the actuator 80, the hinge pin 110 is contemplated to be in the extended position when the actuator 80 is in the at-rest position. This is generally due to the biasing mechanisms 68 (FIG. 2) which are configured to bias the actuator 80 outward towards the at-rest position. Thus, when the actuator 80 is pressed to the actuated position, the hinge pin 110 pivots to the retracted position along swing path SW1 (FIG. 2). With the contact of the hinge pin 110 running substantially the length of the actuator 80, the actuator 80 can be contacted at a variety of vertical positions while consistently providing even linear movement of the actuator 80. For instance, when a user contacts the outer contact surface 82 of the actuator 80 at the position indicated by arrow 124, the actuator will move inwardly towards the pressed or actuated position along the linear path as indicated by arrow 122 while the hinge pin 110 rotates towards the retracted position. The rotation of the hinge pin 110 is consistent along the length of the actuator 80 to which the hinge pin 110 is coupled. Thus, the entirety of the actuator 80 moves inwardly even when the actuator 80 is only contacted at the outer contact surface 82 at an upper portion thereof as indicated by arrow 124. Similarly, when a user contacts the actuator 80 at a lower portion thereof (as indicated by arrow 126), the actuator 80 will move as a single unit in the linear manner as indicated by arrow 122 from the at-rest position to the pressed or actuated position while the hinge pin 110 pivots along swing path SW1 from the extended position to the retracted position. This consistent movement of the actuator 80 provides for consistent results in water dispensing while avoiding issues with the actuator 80 such as jamming. When the actuator 80 is released from contact by a user, the water dispensing will cease and the actuator 80 will move from the actuated position to the at-rest position as biased thereto by biasing mechanisms 68.

Figure 4A:
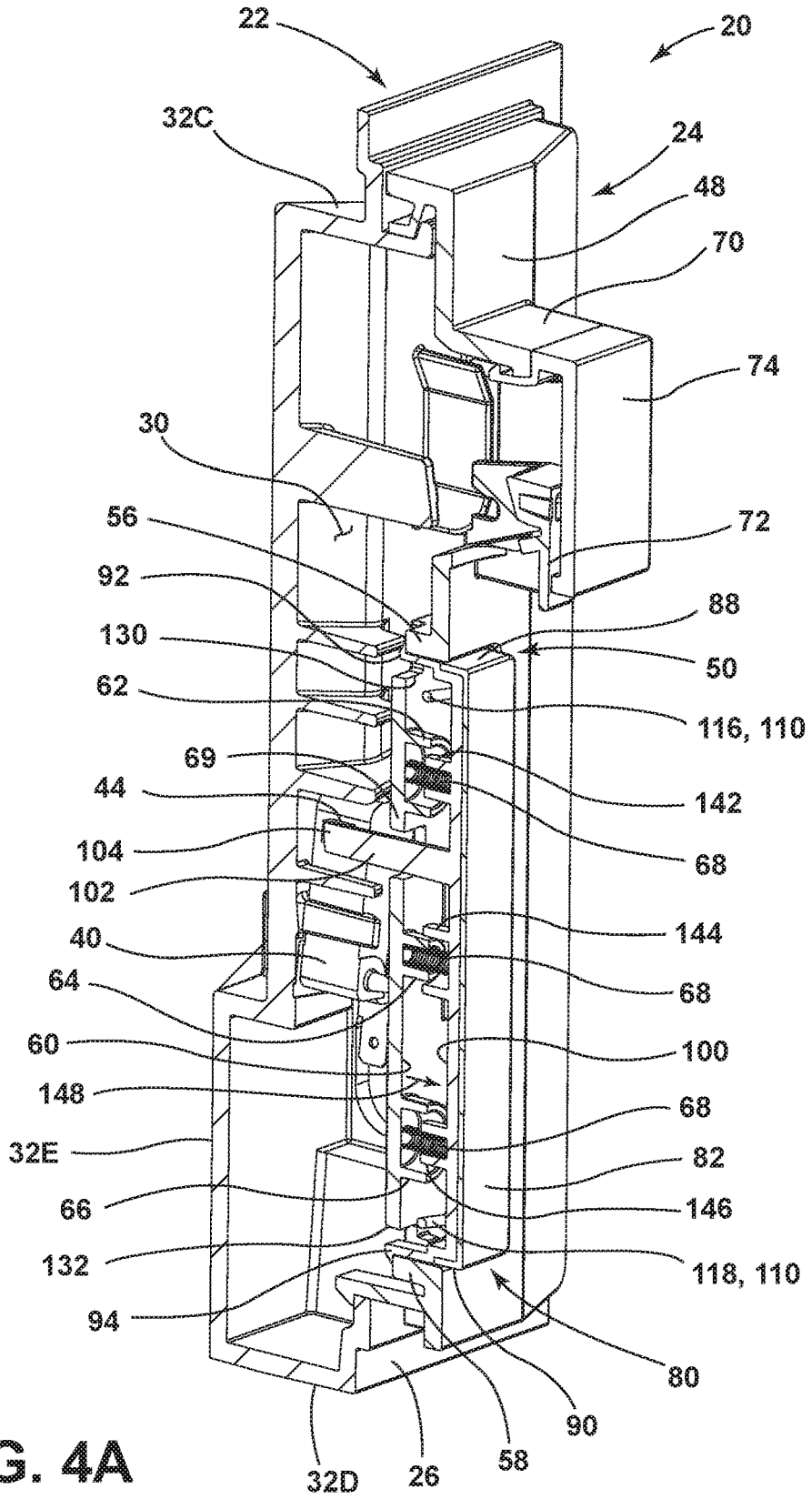
FIG. 4A is a cross-sectional view of the water dispenser assembly of FIG. 3 taken at line IVA.

Referring now to FIG. 4A, the cross-sectional view of the water dispenser assembly 20 shows the interconnection between the front fascia 24 and the housing 22 to define cavity 30, as well as the reception of the actuator 80 within the actuator receiving area 50. In the actuator receiving area 50, upper and lower slots 130, 132 are shown disposed at the upper and lower portions 56, 58 of the actuator receiving area 50. The upper and lower slots 130, 132 are configured to slideably receive the upper and lower retainer members 92, 94, respectively, which outwardly extend in a rearward direction from the actuator 80. The retainer members 92, 94 clip to the slots 130, 132 to define a stop mechanism which retains the actuator 80 within the actuator receiving area 50 by not allowing the actuator 80 to slide completely out of the actuator receiving area 50, as further described below. This positive retention of the actuator 80 by the retainer members 92, 94 acts as a consistent positioning mechanism for properly positioning the actuator 80 at its outermost extended position or at-rest position shown in FIG. 4A. Again, as noted above, biasing mechanisms 68 are used to bias the actuator 80 to the outermost or at-rest position shown in FIG. 4A. Specifically, mounting bosses 62, 64 and 66 extend outwardly from the rear wall 60 of the actuator receiving area 50. Mounting bosses 142, 144 and 146 rearwardly extend from the inner surface 100 of the actuator 80 and are configured for alignment with mounting bosses 62, 64 and 66 of the actuator receiving area 50. Mounting bosses 142, 146 and 64 are configured to receive the biasing mechanisms 68 shown in the form of coil springs in FIG. 4A. Mounting bosses 66, 144 and 62 are configured to receive reciprocal mounting bosses 146, 64 and 142 along with the biasing mechanisms 68, such that the biasing mechanism 68 remain in place during movement of the actuator 80 between the at-rest and pressed positions. Further, the interaction between the mounting bosses 62, 64, 66 of the actuator receiving area 50 and the mounting bosses 142, 144 and 146 of the actuator 80 guides the linear movement of the actuator 80 between the at-rest and pressed positions along the path indicated by arrow 122 in FIG. 3. As shown in FIG. 4A, the biasing mechanisms 68 are configured to bias the actuator 80 outwardly in a direction as indicated by arrow 148 to the at-rest position shown in FIG. 4A.

With further reference to FIG. 4A, the rearwardly extending arm 102 of the actuator 80 is shown disposed adjacent the input contact 44 of the electronic switch 40. Specifically, the distal most end 104 of the arm 102 is disposed adjacent to the input contact 44 of the electronic switch 40. Thus, when the actuator 80 moves from the at-rest position (FIG. 4A) to the actuated position, the distal most end 104 of the arm 102 will contact the input contact 44 to electronically signal for an initiation of a water dispensing sequence. This contact with the electronic switch 40 may also trigger a lighting feature to illuminate the water dispensing area. As noted above, the arm 102 extends through receiving aperture 69 disposed on the rear wall 60 of the actuator receiving area 50, as shown in FIG. 4A to contact the electronic switch 40.

Figure 4B:
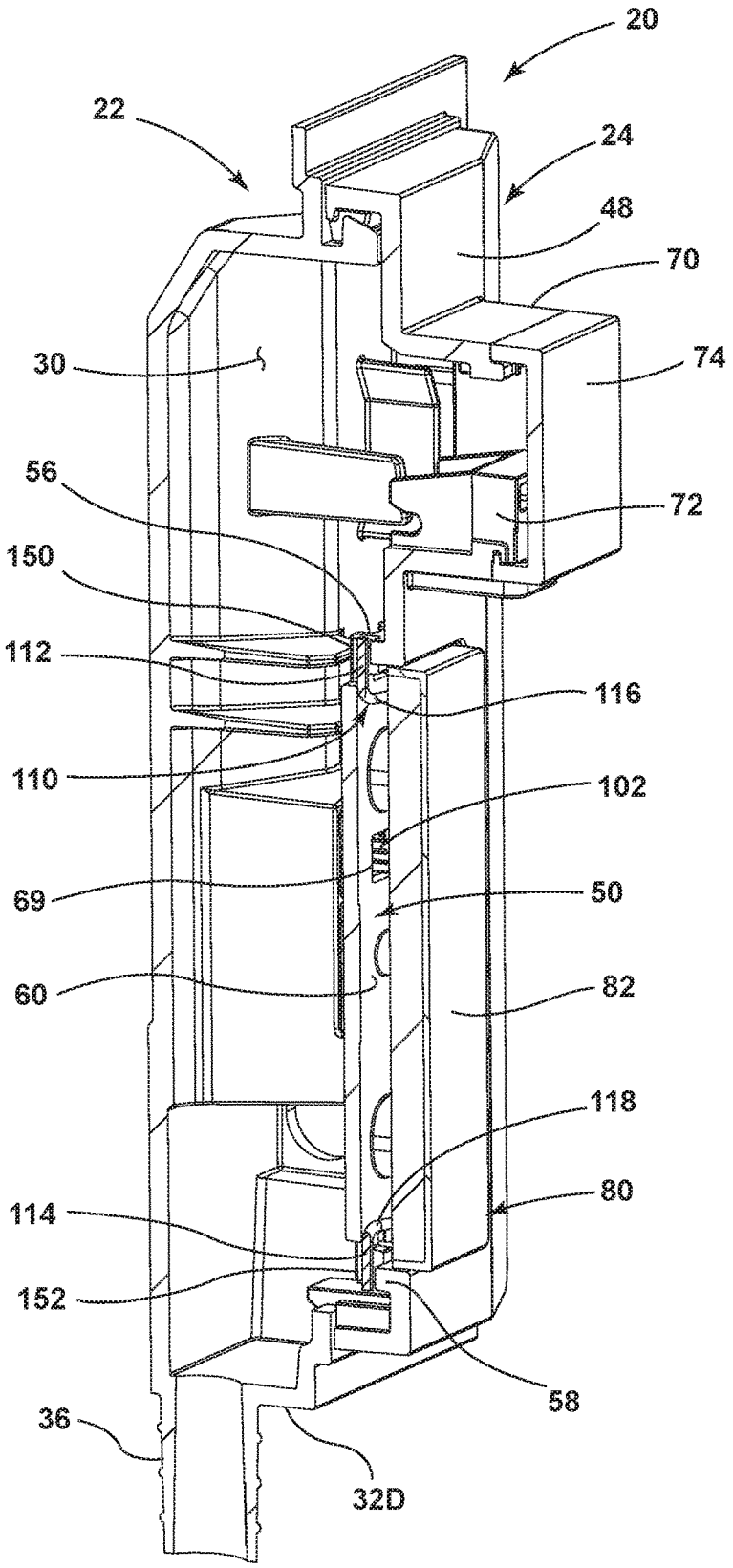
FIG. 4B is a cross-sectional view of the water dispenser assembly of FIG. 3 taken at line IVB.

Referring now to FIG. 4B, the upper and lower ends 112, 114 of the hinge pin 110 are shown received in upper and lower mounting apertures 150, 152 disposed on the upper and lower portions 56, 58 of the actuator receiving area 50. The upper and lower ends 112, 114 of the hinge pin 110 are pivotally received in the mounting apertures 150, 152 for pivoting movement of the hinge pin 110 between the extended and retracted positions.

Figure 5:
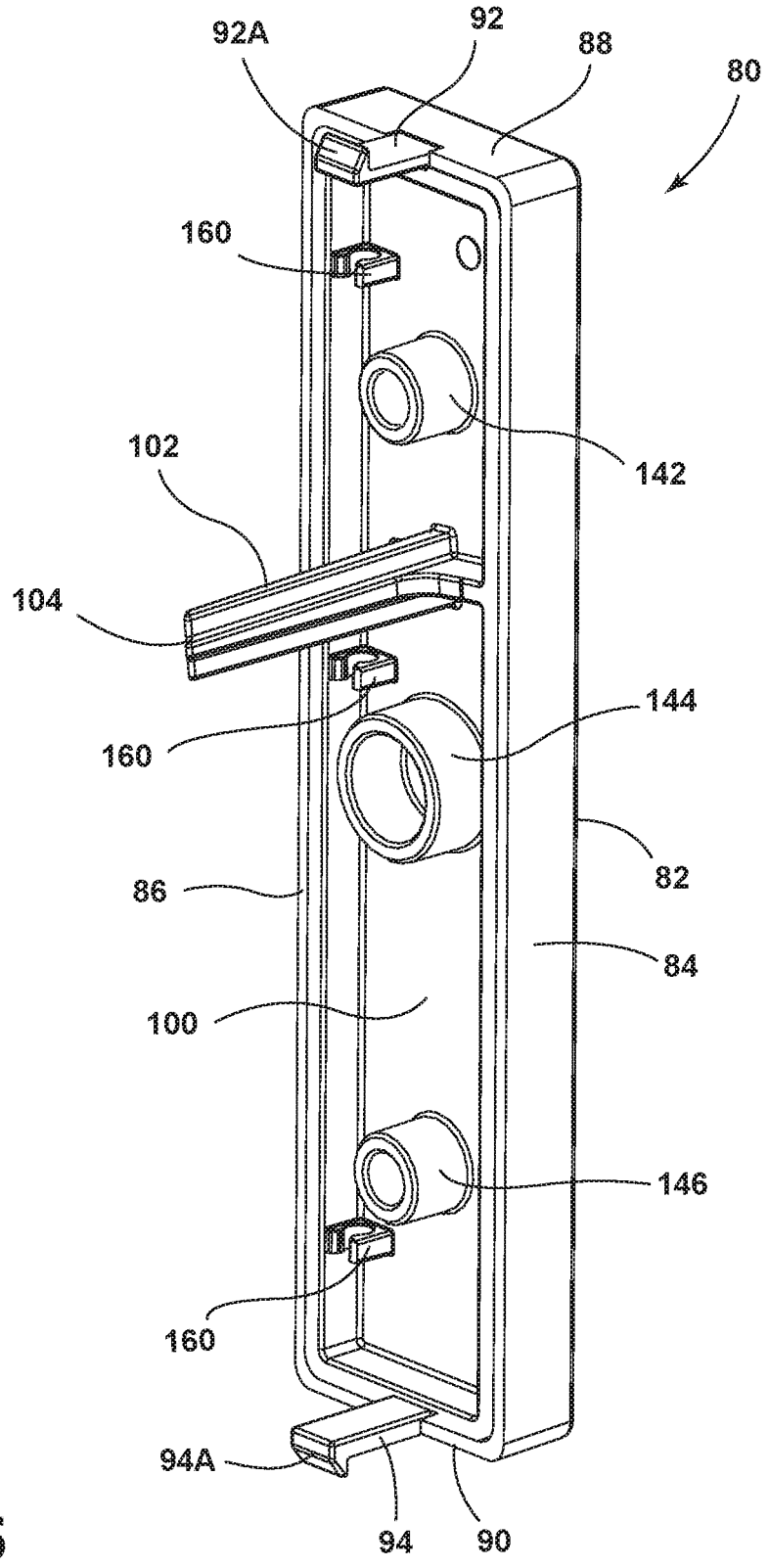
FIG. 5 is a rear perspective view of an actuator pedal.

Referring now to FIG. 5, the upper and lower retainer members 92, 94 of the actuator 80 are shown having catch mechanisms 92A, 94A, respectively, for catching and retaining the actuator 80 within the upper and lower slots 130, 132 shown in FIG. 4A. The inner surface 100 of the actuator 80 is shown having mounting bosses 142, 144 and 146 outwardly extending in a rearward direction therefrom. As further shown in FIG. 5, a plurality of clip members 160 are shown disposed along sidewall 86 of the actuator 80 and rearwardly extending from the inner surface 100 of the actuator 80. The clip members 160 are generally c-shaped clip members which are configured to clip to the body portion 120 of the hinge pin 110 in assembly. In this way, the body portion 120 of the hinge pin 110 is operably coupled to the actuator 80 at the rear surface 100 thereof along a length of the actuator 80. The C-shaped clip members 160 are configured to allow the body portion 120 to rotate between the extended and retracted positions to which the hinge pin 110 moves as the actuator 80 is moved between the at-rest and actuated positions.

Figure 6:
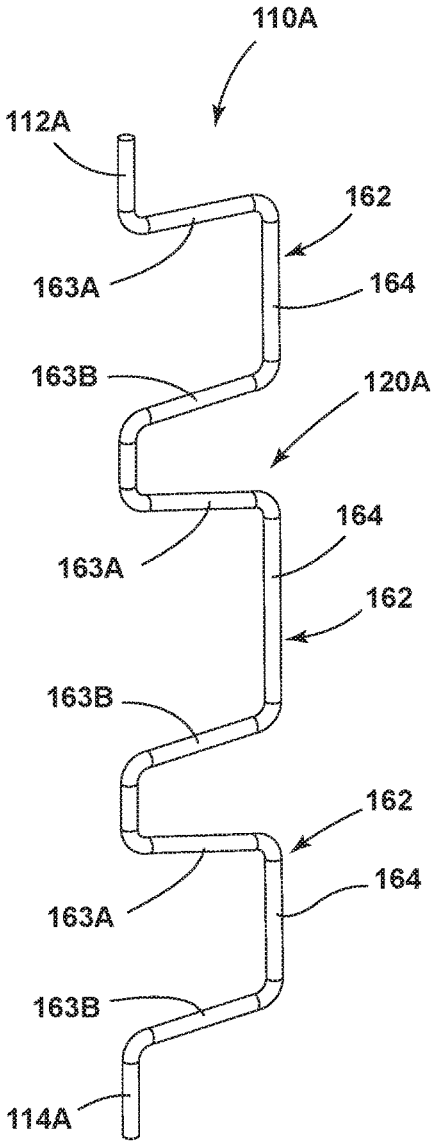
FIG. 6 is a top perspective view of a hinge pin assembly.

Referring now to FIG. 6, another embodiment of a hinge pin 110A is shown having upper and lower ends 112A, 114A. The hinge pin 110A shown in FIG. 6 includes a body portion 120A which includes multiple laterally disposed projections 162. The laterally disposed projections 162 include offset portions 163A, 163B and end portions 164. It is contemplated that the end portions 164 of the projections 162 will couple with clip members 160 disposed on the inner surface 100 of the actuator 80 in assembly. The projections 162 of the body portion 120A of hinge pin 110A provide for a serpentine style winding body portion 120A which provides increased strength and rigidity to the hinge pin 110A.

Figure 7:
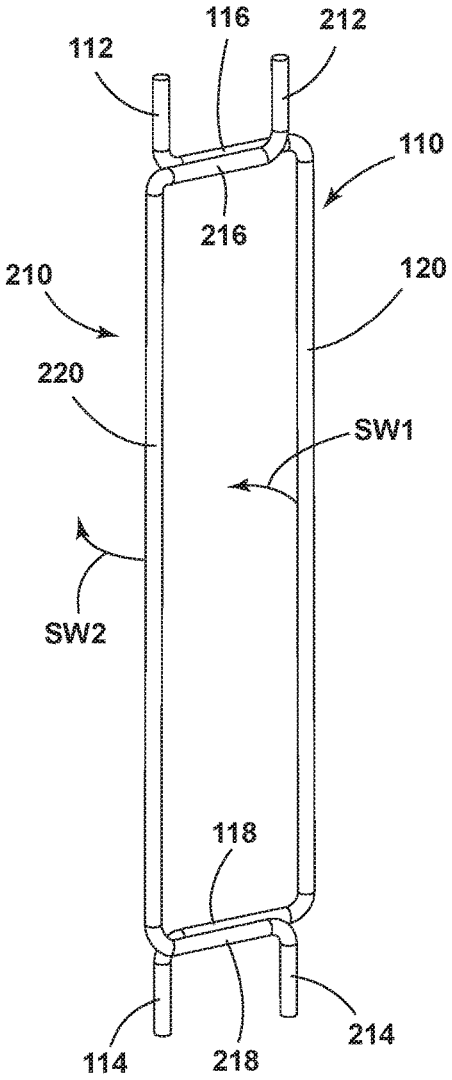
FIG. 7 is a top perspective view of a dual hinge pin assembly.

Referring now to FIG. 7, a dual hinge pin assembly is shown, wherein hinge pin 110 is shown having upper and lower ends 112, 114, offset portions 116, 118 and body portion 120. A second hinge pin 210 includes upper and lower ends 212, 214, offset portions 216, 218 and a body portion 220. In assembly, the upper and lower ends 112, 114 of hinge pin 110 are configured to pivotally couple to a second set of the mounting apertures 150, 152 of the actuator receiving area 50 as shown in FIG. 4B. Further, it is contemplated that the upper and lower ends 212, 214 of hinge pin 210 are also configured to couple to a second set of mounting apertures disposed on the upper and lower portions 56, 58 of the actuator receiving area 50, wherein this second set of mounting apertures is contemplated to be configured like mounting apertures 150, 152, as shown in FIG. 4B, and spaced-apart from the mounting apertures 150, 152. In this way, the dual hinge pin assembly shown in FIG. 7 is configured to have the first hinge pin 110 move along the swing path SW1 between extended and retracted positions. The second hinge pin 210 will also move along a swing path as indicated by arrow SW2 between extended and retracted positions. Swing path SW2 is a mirrored swing path relative to swing path SW1 of the first hinge pin 110. The body portions 120, 220 of the hinge pins 110, 210 are configured to couple to the inner surface 100 of the actuator 80 at clip members, such as clip members 160, as shown in FIG. 5. Thus, when using a dual hinge pin configuration, it is contemplated that the actuator 80 will include clip members 160 disposed along both sidewalls 86 and 84. In this way, both body portions 120, 220 of the hinge pins 110, 210 can couple to the inner surface 100 of the actuator 80. This dual hinge pin configuration shown in FIG. 7 provides for a more robust connection between the actuator 80 and the actuator receiving area 50 for better guiding movement of the actuator 80 between at-rest and actuated positions.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A water dispenser assembly for a refrigerator, comprising:

a housing having a front fascia coupled thereto, the front fascia including an actuator receiving area;

an actuator received in the actuator receiving area having inner and outer surfaces, the actuator operable between at-rest and pressed positions; and a hinge pin having upper and lower ends and a body portion disposed therebetween, the upper and lower ends pivotally coupled to upper and lower portions of the actuator receiving area to rotate the body portion between extended and retracted positions along a vertical rotational axis, wherein the body portion is coupled to the inner surface of the actuator.

2. The water dispenser assembly of claim 1, including:

one or more biasing mechanisms disposed between the front fascia and the actuator, to bias the actuator towards the at-rest position.

3. The water dispenser assembly of claim 1, including:

an electronic switch disposed between the housing and the front fascia.

4. The water dispenser assembly of claim 3, wherein the actuator includes an arm rearwardly extending from the inner surface of the actuator, the arm contacting the electronic switch to activate the electronic switch when the actuator is in the pressed position.

5. The water dispenser assembly of claim 1, wherein the body portion of the hinge pin is disposed along the inner surface of the actuator between uppermost and lowermost portions thereof.

6. The water dispenser assembly of claim 1, including:

upper and lower slots disposed on the upper and lower portions of the actuator receiving area.

7. The water dispenser assembly of claim 6, including:

upper and lower retainer members disposed on the actuator and coupled to the upper and lower slots of the upper and lower portions of the actuator receiving area to retain the actuator in the actuator receiving area.

8. A water dispenser assembly for a refrigerator, comprising:

a housing having an actuator receiving area with upper and lower mounting apertures;

an actuator received in the actuator receiving area, the actuator moveable in a linear manner between at-rest and pressed positions; and a hinge pin having a body portion with off-set upper and lower ends, the off-set upper and lower ends pivotally coupled to the upper and lower mounting apertures of the actuator receiving, area to rotate the body portion between extended and retracted positions, wherein the hinge pin is a unitary member, and further wherein the body portion of the hinge pin is coupled to an inner surface of the actuator.

9. The water dispenser assembly of claim 8, wherein the actuator receiving area is an inset area relative to an outer surface of the housing having a rear wall.

10. The water dispenser assembly of claim 9, including:

one or more mounting bosses outwardly extending from the rear wall.

11. The water dispenser assembly of claim 10, including:

one or more mounting bosses outwardly extending from the inner surface of the actuator and aligned with the one or more mounting bosses disposed along the rear wall when the actuator is received in the actuator receiving area.

12. The water dispenser assembly of claim 11, including:

one or more spring members received in the one or more mounting bosses of the actuator and the one or more mounting bosses of the rear wall to bias the actuator to the at-rest position.

13. The water dispenser assembly of claim 8, wherein the body portion of the hinge pin includes laterally disposed projections having end portions in contact with the inner surface of the actuator.

14. A water dispenser assembly for a refrigerator, comprising:

a housing having an actuator receiving area with upper and lower portions;

an actuator received in the actuator receiving area, the actuator operable between at-rest and actuated positions; and a hinge pin having upper and lower ends, the upper and lower ends pivotally coupled to the upper and lower portions of the actuator receiving area to rotate the hinge pin between extended and retracted positions along a vertical rotational axis, wherein the hinge pin is coupled to an inner surface of the actuator for movement therewith.

15. The water dispenser assembly of claim 14, including:

upper and lower slots disposed on the upper and lower portions of the actuator receiving area.

16. The water dispenser assembly of claim 15, including:

upper and lower retainer members rearwardly extending from upper and lower portions of the actuator and slideably received in the upper and lower slots of the upper and lower portions of the actuator receiving area.

17. The water dispenser assembly of claim 14, including:

one or more clip members disposed on the inner surface of the actuator, wherein the hinge pin is coupled to the clip members.

18. The water dispenser assembly of claim 14, including:

one or more biasing mechanisms disposed between the housing and the actuator, to bias the actuator towards the at-rest position.

19. The water dispenser assembly of claim 14, including:

a second hinge pin having upper and lower ends, the upper and lower ends of the second hinge pin pivotally coupled to the upper and lower portions of the actuator receiving area to rotate the second hinge pin along a mirrored swing path relative to a swing path of the first hinge pin, wherein the second hinge pin is coupled to the inner surface of the actuator for movement therewith.

20. The water dispenser assembly of claim 14, wherein the actuator is an elongate pedal member.

* * * * *